US007763410B2

(12) United States Patent
Yamaguchi et al.

(10) Patent No.: US 7,763,410 B2
(45) Date of Patent: Jul. 27, 2010

(54) ELECTROPHOTOGRAPHIC DEVELOPING CARRIER, ASSOCIATED APPARATUS AND METHODOLOGY OF CLASSIFICATION AND APPLICATION

(75) Inventors: Kimitoshi Yamaguchi, Numazu (JP); Masashi Nagayama, Numazu (JP); Naoki Imahashi, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 586 days.

(21) Appl. No.: 10/977,013

(22) Filed: Nov. 1, 2004

(65) Prior Publication Data

US 2005/0158643 A1 Jul. 21, 2005

(30) Foreign Application Priority Data

Nov. 18, 2003 (JP) ..... 2003-388599
Jul. 13, 2004 (JP) ..... 2004-206102

(51) Int. Cl.
*G03G 9/10* (2006.01)

(52) U.S. Cl. ..... 430/137.2; 430/137.1; 209/311; 209/327; 209/401

(58) Field of Classification Search ..... 430/105, 430/137.1, 137.2; 209/311, 401, 327; 210/238
See application file for complete search history.

(56) References Cited

U.S. PATENT DOCUMENTS

| | | | | |
|---|---|---|---|---|
| 4,590,141 | A | 5/1986 | Aoki et al. | |
| 4,670,368 | A | 6/1987 | Tosaka et al. | |
| 4,950,573 | A | 8/1990 | Yamaguchi et al. | |
| 4,990,425 | A | 2/1991 | Nanya et al. | |
| 5,079,123 | A | 1/1992 | Nanya et al. | |
| 5,085,965 | A | 2/1992 | Nanya et al. | |
| 5,102,766 | A | 4/1992 | Nanya et al. | |
| 5,288,577 | A | 2/1994 | Yamaguchi et al. | |
| 5,653,346 | A * | 8/1997 | Frei et al. | 209/254 |
| 5,915,566 | A | 6/1999 | Senapati | |
| 6,296,826 | B1 * | 10/2001 | Fujinoki et al. | 423/335 |
| 6,303,257 | B1 | 10/2001 | Hasegawa et al. | |
| 6,319,646 | B1 | 11/2001 | Suganuma | |
| 6,472,118 | B1 | 10/2002 | Yamaguchi et al. | |
| 6,489,073 | B2 | 12/2002 | Kotsugai et al. | |
| 6,599,672 | B2 | 7/2003 | Yamaguchi et al. | |
| 6,696,213 | B2 | 2/2004 | Yamaguchi et al. | |

(Continued)

FOREIGN PATENT DOCUMENTS

DE 195 18 358 C1 12/1996

(Continued)

OTHER PUBLICATIONS

U.S. Appl. No. 11/373,109, filed Mar. 13, 2006, Imahashi, et al.

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A vibrating sieve for classifying a particulate material, including an oscillator comprising a transducer; and at least two meshes layered together and located in contacting relation to a transducer, wherein a lowermost mesh receiving a vibration from the transducer transmits the vibration to an uppermost mesh to classify the particulate material fed thereon.

7 Claims, 2 Drawing Sheets

U.S. PATENT DOCUMENTS

| | | | | |
|---|---|---|---|---|
| 6,735,409 | B2 | 5/2004 | Takahashi et al. | |
| 6,739,534 | B2 | 5/2004 | Yamaguchi et al. | |
| 6,743,558 | B2 | 6/2004 | Yamaguchi et al. | |
| 2002/0172884 | A1* | 11/2002 | Kayamoto et al. | 430/111.41 |
| 2002/0187252 | A1* | 12/2002 | Singh et al. | 427/2.31 |
| 2003/0054279 | A1* | 3/2003 | Yamaguchi et al. | 430/111.35 |
| 2003/0143000 | A1 | 7/2003 | Takahashi et al. | |
| 2003/0165759 | A1 | 9/2003 | Suzuki et al. | |
| 2003/0211415 | A1 | 11/2003 | Yamaguchi et al. | |
| 2003/0219670 | A1 | 11/2003 | Sawada et al. | |
| 2003/0224279 | A1 | 12/2003 | Kotsugai et al. | |
| 2004/0142269 | A1 | 7/2004 | Kotsugai et al. | |

FOREIGN PATENT DOCUMENTS

| | | |
|---|---|---|
| EP | 1 158 366 B1 | 11/2001 |
| JP | 2001-209215 | 8/2001 |
| WO | WO 00/58031 | 10/2000 |

OTHER PUBLICATIONS

U.S. Appl. No. 11/222,775, filed Sep. 12, 2005, Nagayama, et al.
U.S. Appl. No. 11/508,922, filed Aug. 24, 2006, Imahashi, et al.
U.S. Appl. No. 11/736,351, filed Apr. 17, 2007, Yamaguchi, et al.
U.S. Appl. No. 11/958,728, filed Dec. 18, 2007, Nagayama, et al.
U.S. Appl. No. 12/013,108, filed Jan. 11, 2008, Yagi, et al.
U.S. Appl. No. 12/015,109, filed Jan. 16, 2008, Nagayama, et al.
U.S. Appl. No. 12/040,451, filed Feb. 29, 2008, Saitoh, et al.
U.S. Appl. No. 12/048,997, filed Mar. 14, 2008, Yamaguchi, et al.
U.S. Appl. No. 12/189,384, filed Aug. 11, 2008, Imahashi, et al.
U.S. Appl. No. 12/209,607, filed Sep. 12, 2008, Nagayama, et al.

* cited by examiner

ELECTROPHOTOGRAPHIC DEVELOPING CARRIER, ASSOCIATED APPARATUS AND METHODOLOGY OF CLASSIFICATION AND APPLICATION

BACKGROUND OF THE INVENTION

The present invention relates to a carrier, a classifier for classifying the carrier, a method of classifying the carrier, a method of preparing the carrier, a developer using the carrier and a process cartridge using the developer.

Electrophotographic developing methods include a one-component developing method using only a toner, and, a two-component developing method using a two-component developer including a carrier and a toner.

The carrier in the two-component developer expands a charged area of the toner, and therefore the two-component developer has more stable charge ability than the one-component developer. In this way, the two-component developer is more advantageous to produce quality images for long periods. Further, since the two-component developer has a high toner supply capacity to a developing area, it is widely used.

Recently, in order to improve image resolution, reproducibility, and colored images, a developing system capable of consistently developing a latent image is essential. Therefore, various methods are employed in terms of both process and developer (toner and carrier). In terms of the process, a closer developing gap, a thinner film of the photoreceptor and a smaller diameter of the writing beam are effectively used. However, the high costs and low reliability of these method are still to be improved.

A toner having a small particle diameter largely improves reproducibility of dot images. However, a developer including such a toner still poses difficulties, such as background fouling and insufficient image density.

On the other hand, a carrier having a small particle diameter is known to have the following advantages.

(1) Since the carriers have a large surface area together, an individual toner can sufficiently be charged and there is less low-charged or reverse-charged toner. In addition, the resultant images have good "dot" reproducibility with less scattered spots and blurred images around a reproduced dot.

(2) Since the carriers have a large surface area together, an average charge amount of the toner can be lower. Therefore, the carrier having a small particle diameter can offset disadvantages of the toner having a small particle diameter, and at the same time, can bring out advantages thereof.

(3) The carriers having a small particle diameter form a microscopic magnetic brush and the resultant image seldom has a tip imprint.

However, conventional carries having a small particle diameter tend to adhere to photoreceptors and fixing rollers, and have problems in practical application. The carriers which are likely to adhere thereto are carriers having smaller particle diameters, and therefore various classification methods of narrowing the particle diameter distribution have been suggested.

Among the various classification methods, a classification method using a sieve can improve classification, as compared to a classification method using a centrifugal force or an air blow, and can collect particles having a desired particle diameter at a high yield.

However, the classification method using a sieve is known to have a difficulty in making the particle diameter distribution of particles having a small mass narrow.

As a method of solving this problem, Japanese Laid-Open Patent Publication No. 2001-209215 discloses a method of efficiently cutting particles having a particle diameter less than 22 μm by imparting an ultrasonic vibration to a metallic mesh of a sieve to give an accelerated velocity to the particles in a direction of up and down to prepare a carrier having high durability and less adherence, wherein the carrier has a weight-average particle diameter (Dw) of from 25 to 45 μm, a content of the particles having a particle diameter not greater than 44 μm not less than 70% by weight, a content of the particles having a particle diameter not greater than 22 μm not greater than 7% by weight and a ratio (Dw/Dp) of the weight-average particle diameter to a number-average particle diameter (Dp) of from 1 to 1.30.

This method can efficiently pass particles having a small particle diameter through a mesh because an accelerated velocity is given to them in a direction of up and down to substantially move like particles having a large mass, i.e., a true specific gravity. Further, it is disclosed that an ultrasonic transducer with a resonant ring is used to improve efficiency of the sieve.

However, when a sieve has a mesh having small openings, since a mesh material is thin and a strength of the mesh is small (a thread is thin), an edge of the mesh is broken due to a weight of the carrier after used for a long time. Therefore, fine particles are mixed in the carrier having a desired particle diameter, resulting in a higher content of the fine particles.

When the mesh is clogged, the carrier hide among openings and it is quite difficult to remove the carrier, resulting in a need to replace the mesh.

Some meshes are woven with a resin thread, and usually with a stainless thread. Since the resin thread has a small stiffness, an ultrasound is not effectively transmitted to the mesh to classify.

On the other hand, production costs of a stainless mesh having small openings are extremely high, resulting in higher production costs of the carrier.

For at least the aforementioned reasons, a need exists for a method of preparing a carrier having a small particle diameter at low cost, which produces high quality images, and which has less adherence and a focused particle diameter distribution.

SUMMARY OF THE INVENTION

The present invention provides a carrier having a small particle diameter at low cost, which produces high quality images, and which has less adherence and a focused particle diameter distribution. Exemplary embodiments of the invention provide a classifier classifying the carrier, a method of classifying the carrier, a method of preparing the carrier, a developer using the carrier, and a process cartridge using the developer.

It is to be understood that both the foregoing general description of the invention and the following detailed description are exemplary, but not restrictive, of the invention.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
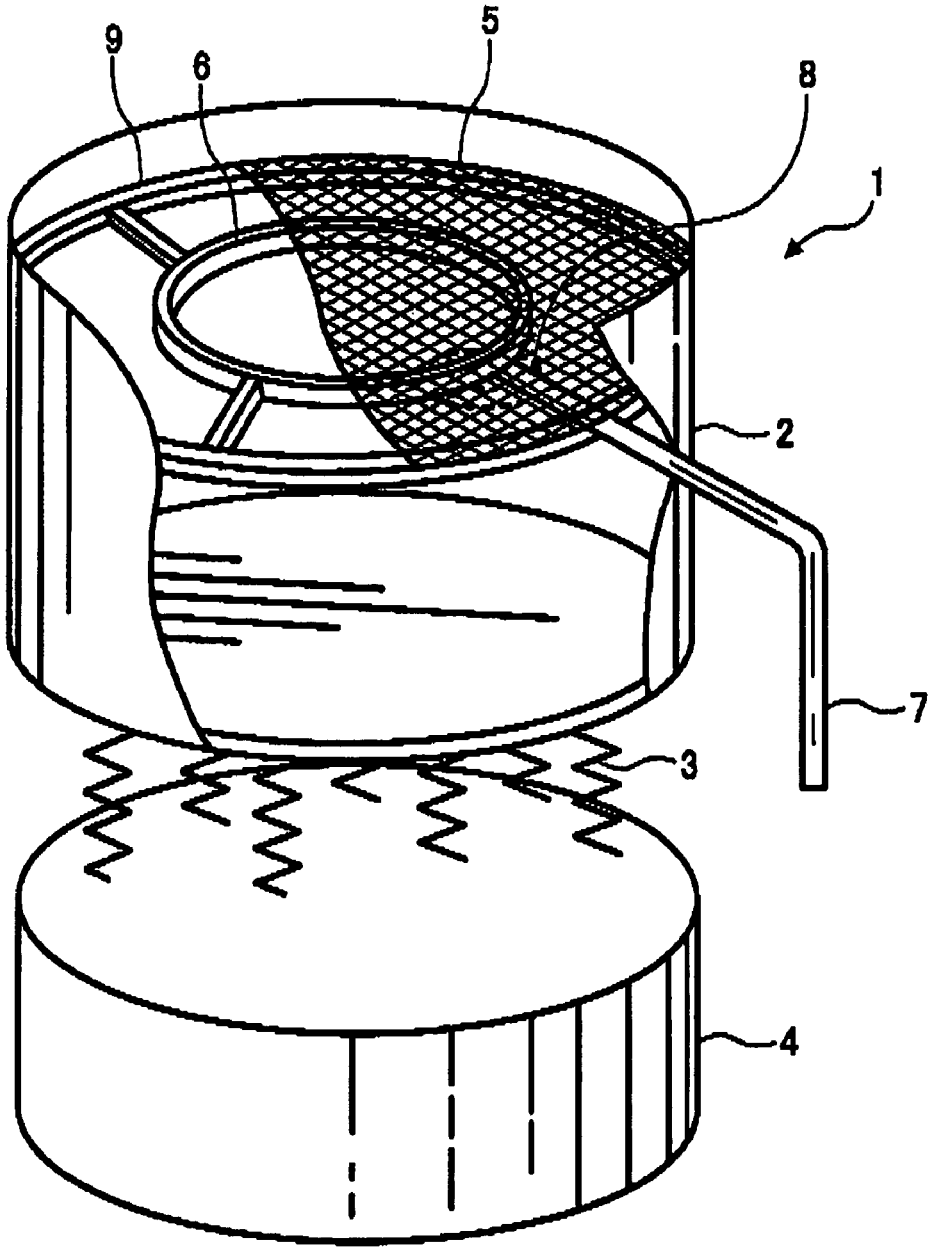
FIG. 1 is a schematic view illustrating an exemplary embodiment of the vibrating sieve with an ultrasonic oscillator.

The present invention provides a method of preparing a carrier having a small particle diameter at low cost, which produces high quality images, and which has less adherence and a focused particle diameter distribution.

More particularly, a vibrating sieve is provided for classifying a carrier, which includes an oscillator comprising a transducer, for example, an ultrasonic transducer; and at least two meshes layered together and operably linked to the ultrasonic transducer, wherein a lowermost mesh receiving a vibration from the ultrasonic transducer transmits the vibration to an uppermost mesh to classify the carrier provided thereon. Of course, those skilled in the art will recognize that each mesh may be independently vibrated by separate transducers, for example. Further, the uppermost mesh preferably has a flexural modulus of about 1 to 10 Gpa.

A carrier coated with a resin, having a focused particle diameter distribution, can be prepared by coating the surface of a magnetic particulate core material with a resin and classifying the resin-coated magnetic particulate core material by the above-mentioned vibrating sieve.

When two meshes are closely contacted to each other, in the exemplary embodiment, the upper mesh has relatively smaller openings as compared to the lower mesh. The upper mesh having small openings has a classifying function and the lower mesh having relatively larger openings receives a vibration from the ultrasonic transducer and transmits the vibration to the upper mesh and substantially support a weight of the carrier. Therefore, when classifying the carrier, a load onto the upper mesh decreases and the upper mesh can be used for a long time, in other words, has a long life.

In the exemplary embodiment, the lower mesh efficiently transmits an ultrasonic vibration and is difficult to abrade and cut, e.g., the exemplary mesh is woven with a thick thread. The openings are larger than a maximum particle diameter of the carrier. For example, when the carrier having a weight-average particle diameter range of about 22 to 45 μm is classified, it is sufficient that the lower mesh has an opening of not less than about 62 μm (250 meshes). Further, since the ultrasonic vibration is difficult to transmit when the mesh has too large a wire diameter, the opening is about 104 μm (150 meshes).

In addition, the exemplary lower mesh is formed of a hard metallic material having a flexural modulus range of about 50 Gpa to 500 Gpa to efficiently transmit a vibration energy.

The mesh can have two or more layers, wherein a lower most mesh has a supporting function and an uppermost mesh has a classifying function. The uppermost mesh can have openings suitable for the particle diameter of a carrier to be classified. There being the lowermost mesh, the uppermost mesh can have large openings.

When the vibrating sieve with an ultrasonic oscillator of the exemplary embodiment has a resonant member in contacting relation, an ultrasonic vibration can be uniformly transmitted to the whole mesh therethrough and a material on the mesh can be efficiently sieved.

The ultrasonic vibration vibrating the mesh can be generated by providing a high-frequency current to a converter converting the current to an ultrasonic vibration. The converter can be a piezo-electric (PZT) transducer, for example. The ultrasonic vibration generated by the converter is transmitted to the resonant member on the mesh, and the resonant member vibrates the mesh.

The exemplary mesh has a vibration frequency range of about 20 to 50 kHz, and more preferably of from 30 to 40 kHz. The resonant member can have any shape suitable for vibrating the mesh, and usually has the shape of a ring. The mesh preferably vibrates vertically; however, those skilled in the art will recognize that alternative methods can be employed.

FIG. 1 is a schematic view illustrating an exemplary embodiment of the exemplary vibrating sieve with an ultrasonic oscillator for use in the classifying method.

In FIG. 1, a vibrating sieve is generally designated 1 and includes a cylindrical container 2, spring 3, a base 4 (support), two or more closely layered meshes 5 and the lowermost mesh has large openings relative to the uppermost, a resonant member 6 (having the shape of a ring in this embodiment), a high-frequency current cable 7, a converter 8, and a ring-shaped frame 9. Those skilled in the art will recognize that alternative frame shapes are possible, and that the container 2 can be supported by alternative structures to springs 3.

To operate the vibrating sieve with an ultrasonic oscillator (circular sieve) in FIG. 1, at first, a high-frequency current is provided to the converter 8 through the cable 7. The high-frequency current provided to the converter 8 is changed to an ultrasonic vibration.

The ultrasonic vibration generated at the converter 8 in the exemplary embodiment vertically vibrates the resonant member 6. The converter 8 is fixed to the junctual ring-shaped frame 9 in the exemplary embodiment. The vibration of the resonant member 6 vertically vibrates the meshes 5 on the resonant member 6 and frame 9.

A marketed vibrating sieve with an ultrasonic oscillator such as ULTRASONIC from Koei Sangyo Co., Ltd., of Tohkai-shi, Aichi-ken, Japan, can be used.

Any particles which are not at all classified, or classified by air or mechanically can be classified by the classifier of the exemplary embodiment. Further, according to the particle diameter distribution, fine particles, coarse particles or both of them can be classified.

Particularly, the classifier classifies the coarse particles into a narrower particle diameter distribution than known classifying methods, such as air classifying method, and is able to collect particles having a desired particle diameter at a high yield.

The uppermost exemplary mesh can be formed with woven thin lines or holes can be formed thereon by a laser or an etching.

However, since the carrier is almost spherical and the circular holes tend to be clogged, a fibrous mesh woven with various materials is used in the exemplary embodiment.

Further, the exemplary uppermost mesh is formed of a material having a flexural modulus range of about 1 to 10 Gpa.

When the uppermost mesh has a smaller elasticity than the lowermost mesh, the openings of the uppermost mesh are slightly transformed by a vibration transmitted from the lowermost mesh to prevent the mesh from being clogged, and which improves efficiency of the classification.

When the uppermost mesh has a flexural modulus greater than 10 Gpa, the openings thereof are less transformed and the mesh tends to be clogged, resulting in deterioration of efficiency of the classification. When less than 1 Gpa, the uppermost mesh absorbs the vibration of the lowermost mesh and the openings of the uppermost mesh are largely transformed, resulting in deterioration of efficiency of the classification.

The materials of the uppermost mesh are not particularly limited, provided they have a flexural modulus range of about 1 to 10 Gpa, but they are preferably resins because of their low production costs. The smaller the openings of the mesh, the lower the production costs of the resin mesh. For example, the production costs per unit area of a nylon mesh having an opening range of about 20 μm is about 1/20 of a stainless mesh.

The uppermost mesh having small openings and a moderate elasticity has a short life is not suitable for the mesh for an ultrasonic vibrating sieve because of its insufficient strength when having no mesh beneath. Therefore, when used together with a mesh having a flexural modulus range of about 50 to 500 Gpa and sufficient strength beneath, the ultrasonic vibrating sieve has better classifying preciseness and efficiency.

The methods of preparation and materials of the resin mesh are not particularly limited except for the flexural modulus. Known resins such as a nylon resin, a polyester resin, an acrylic resin and a fluorocarbon resin can be used, provided they can form a mesh.

Among the resins, the nylon resin is used in terms of its durability and chemical resistance, and the polyester resin is used in terms of its durability and environmental resistance.

Marketed nylon meshes and polyester meshes such as NYTAL and PETEX series from Sefar Holding Inc. in Switzerland can be used.

When the fibrous resin is woven, only one of either a warp or a weft can be used.

The mesh having a flexural modulus not greater than 10 Gpa occasionally has an insufficient strength when having no mesh beneath and is not suitable for the mesh for an ultrasonic vibrating sieve. However, as mentioned above, the double mesh has sufficient strength and durability, and the resultant vibrating sieve has better classifying preciseness and efficiency.

The flexural modulus of the mesh can be measured according to D790 of ASTM (American Society for Testing and Materials). The flexural modulus in the present invention is measured according to ASTM D790.

The magnetic particulate carrier (core material) or resin-coated magnetic particulate carrier classified by the classifier of the exemplary embodiment has an arrow particle diameter distribution, a weight-average particle diameter (Dw) range of about 30 to 45 μm, a content of the particles having a particle diameter less than about 44 μm not less than about 70% by weight, a content of the particles having a particle diameter less than about 22 μm not greater than about 7% by weight, and a ratio (Dw/Dp) of the weight-average particle diameter (Dw) to a number-average particle diameter (Dp) range of about 1 to 1.30, and preferably from 1 to 1.25. Therefore, the carrier of the present invention produces images having good granularity without background fouling.

The smaller the weight-average particle diameter (Dw), the better the granularity (uniformity of highlight image), but carrier adherence tends to occur. Once the carrier adherence occurs, the granularity deteriorates.

On the contrary, the larger the weight-average particle diameter (Dw), the less the carrier adherence, but when the toner concentration is increased to increase image density, the background fouling tends to occur.

The carrier adherence means phenomena wherein the carrier adheres to the image portion or background of an electrostatic latent image. The larger the electric field intensity of the respective area, the more the carrier tends to adhere. However, since the image portion has a weaker electric field intensity than the background because a toner is developed, the image portion has less carrier adherence.

When the photoreceptor used in an electrophotographic image forming apparatus is observed after using the carrier therein, which has a weight-average particle diameter (Dw) range of about 30 to 45 μm and a content of the particles having a particle diameter less than about 44 μm not less than about 70% by weight, almost all the adhered carries have particle diameter less than about 22 μm.

Then, the present inventors discovered that the carrier having a weight-average particle diameter (Dw) range of about 30 to 45 μm and a content of the particles having a particle diameter less than about 22 μm not greater than about 7%, and preferably not greater than about 3% by weight adheres less.

When the carrier has a weight-average particle diameter (Dw) range of from about 22 to 32 μm, it is essential that the carrier has a content of the particles having a particle diameter less than about 36 μm of from about 90 to 100% by weight, a content of the particles having a particle diameter less than about 20 μm not greater than about 7% by weight and a ratio (Dw/Dp) of the weight-average particle diameter (Dw) to a number-average particle diameter (Dp) of from about 1 to 1.30.

When the carrier has a weight-average particle diameter (Dw) range of from about 22 to 32 μm, the carrier produces images having very good granularity without background fouling even when a toner concentration is high.

In addition, the carrier having a content of the particles having a particle diameter less than about 36 μm of from about 90 to 100% by weight, a content of the particles having a particle diameter less than about 20 μm not greater than about 7%, and preferably not greater than about 3% by weight and a ratio (Dw/Dp) of the weight-average particle diameter (Dw) to a number-average particle diameter (Dp) range of about 1 to 1.30, and preferably from about 1 to 1.25 adheres less.

Known magnetic materials can be used for the core material of the carrier of the present invention.

The carrier core material for use in the present invention has a magnetic moment not less than about 50 emu/g, and preferably not less than about 60 emu/g when a magnetic field of about 1,000 oersted (Oe) is applied thereto. The maximum magnetic moment is not particularly limited, but usually about 150 emu/g. When the magnetic moment is less than about 50 emu/g, the carrier adherence tends to occur.

The magnetic moment can be measured as follows:

1.0 g of the carrier core material is filled in a cylindrical cell of a B-H tracer (BHU-60 from Riken Denshi Co., Ltd., of Megruro-ku, Tokyo, Japan). The magnetic field is gradually increased up to 3,000 Oe, and is gradually decreased small down to 0. Then, the reverse magnetic field is gradually increased up to 3,000 Oe.

Further, after the magnetic field is gradually decreased, a magnetic field is applied in the first direction again. Thus, a B-H curve is illustrated, and from which a magnetic moment at 1,000 Oe is determined.

Specific examples of the core material having a magnetic moment not less than 50 emu/g when a magnetic field of 1,000 Oe is applied thereto include, but are not limited to, ferromagnets such as iron and cobalt, magnetite, hematite, Li ferrite, Mn—Zn ferrite, Cu—Zn ferrite, Ni—Zn ferrite, Ba ferrite and Mn ferrite.

The ferrite is a sintered compact constituted of a perfect mixture of divalent metal oxide and trivalent iron oxide, which has the following formula:

$$(MO)x(NO)y(Fe_2O_3)z$$

wherein x+y+z=100 mol %; and M and N are metal atoms such as Ni, Cu, Zn, Li, Mg, Mn, Sr and Ca.

Specific examples of the exemplary core material, having a magnetic moment not less than 60 emu/g when a magnetic field of 1,000 Oe is applied thereto include, but are not limited to, magnetic particulate materials such as iron, magnetite, Mn—Mg ferrite and Mn ferrite.

The resin-coated particulate carrier for use in the exemplary embodiment can be prepared by forming resin layers on the above-mentioned core materials.

Known resins for use in preparation of a carrier can be used for forming the resin layer. The following resins can be used alone or in combination in the present invention.

Silicone resins; styrene resins such as polystyrene, chloropolystyrene, poly-α-methylstyrene, styrene-chlorostyrene copolymers, styrene-propylene copolymers; styrene-butadiene copolymers, styrene-vinylchloride copolymers, styrene-vinylacetate copolymers; styrene-maleic acid copolymers, styrene-esteracrylate copolymers (styrene-methylacrylate copolymers, styrene-ethylacrylate copolymers, styrene-butylacrylate copolymers, styrene-octylacrylate copolymers, styrene-phenylacrylate copolymers, etc.) and styrene-estermethacrylate copolymers (styrene-methylmethacrylate copolymers, styrene-ethylmethacrylate copolymers, styrene-butylmethacrylate copolymers, styrene-phenylmethacrylate copolymers, etc.); epoxy resins; polyester resins; polyethylene resins; polypropylene resins; ionomer resins; polyurethane resins; ketone resins; ethylene-ethylacrylate copolymers; xylene resins; polyamide resins; phenol resins; polycarbonate resins; melamine resins; etc.

Specific examples of the silicone resins include, but are not limited to, Kr271, KR272, KR282, KR252, KR255 and KR152 from Shin-Etsu Chemical Co., Ltd., of Chiyoda-ku, Tokyo, Japan; and SR2400, SR2406 from Dow Corning Toray Silicone Co., Ltd., of Chiyoda-ku, Tokyo, Japan.

Specific examples of modified-silicone resins include, but are not limited to, epoxy-modified silicone, acrylic-modified silicone, phenol-modified silicone, urethane-modified silicone, polyester-modified silicone and alkyd-modified silicone.

Known methods such as a spray dry coating method, a dip coating method and a powder coating method can be used to form a resin layer on the surface of a particulate carrier core material. Particularly, a fluidized bed coater is effectively used to form a uniform coated layer.

The resin layer formed on the particulate carrier core material preferably has a thickness of from 0.02 to 1 μm, and more preferably from 0.03 to 0.8 μm.

The carrier of the exemplary embodiment can be a resin dispersion carrier, wherein a magnetic powder is dispersed in known resins such as a phenol resin, an acrylic resin and a polyester resin.

The carrier of the exemplary embodiment has a resistivity Log R (R is a resistibility of the carrier) not greater than about 15.0 Ωcm, and preferably not greater than about 14.0 Ωcm. The minimum resistivity is not particularly limited, but usually about 10.0 Ωcm. When the resistivity of the carrier is higher than about 15.0 Ωcm, the carrier adherence tends to occur. When the resistivity is within the above-mentioned range, the carrier adherence is difficult to occur and developability of the carrier increases to produce images having sufficient image density.

The carrier resistivity can be measure by the following method.

Figure 2:
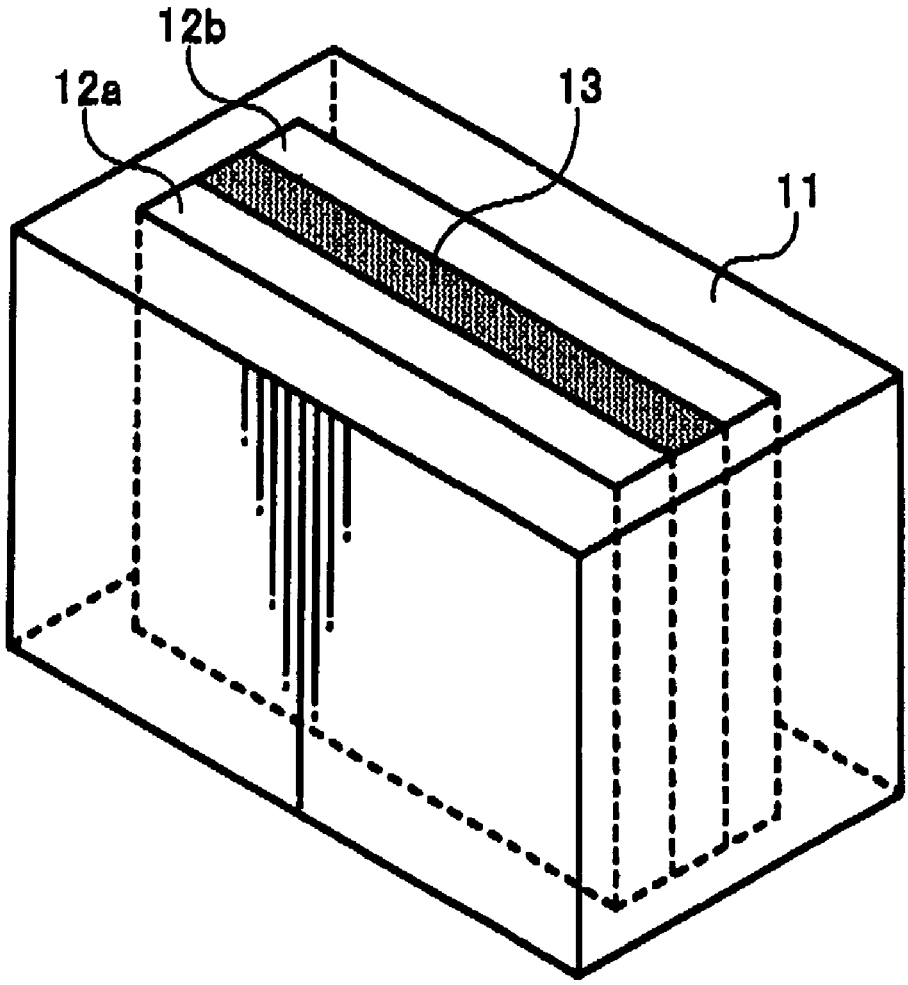
FIG. 2 is an oblique perspective view illustrating the resistivity measurement cell measuring an electric resistivity of a carrier.

As shown in FIG. 2, a carrier 13 is filled in a cell 11 formed of a fluorocarbon resin container containing electrodes 12*a* and 12*b* having a distance therebetween of 2 mm and a surface area 2×4 cm, a DC voltage of 100 V is applied therebetween and a DC resistivity is measured by a High Resistance Meter 4329A from Hewlett-Packard Development Company, L.P. of California, U.S.A., to determine the electric resistivity Log R (Ωcm).

The resistivity of the carrier can be controlled by controlling the resistivity and thickness of a coated resin layer on the particulate core material, or adding an electroconductive fine powder to the coated resin layer.

Specific examples of the electroconductive fine powder include, but are not limited to, metal or metal oxide powders such as electroconductive ZnO and Al; SnO2 prepared by various methods or doped with various atoms; borides such as TiB2, ZnB2 and MoB2; SiO2; electroconductive polymers such as polyacetylene, polyparaphenylene, poly(paraphenylenesulfide)polypyrrole and polyethylene; and carbon blacks such as furnace black, acetylene black and channel black.

These electroconductive fine powders can uniformly be dispersed in a disperser using media such as ball mill and beads mill or a stirrer equipped with a blade rotating at a high-speed after included in a solvent or a resin solution for coating.

Next, the resin-coated magnetic particles prepared by the classifying method of the exemplary embodiment is mixed with a toner to prepare a developer, and the toner will be explained.

The toner for use in the present invention includes a thermoplastic binder resin as a main component, a colorant, a particulate material, a charge controlling agent, a release agent, etc., and known toners can be used in the present invention. The toner may be an amorphous or a spherical toner prepared by various methods such as polymerization methods and granulation methods. In addition, either a magnetic or a non-magnetic toner can be used in the present invention.

In the exemplary embodiment, the weight-average particle diameter Dw of the carrier or the core material thereof is determined according to the particle diameter distribution measured on a number standard (a relation ship between the number frequency and particle diameter). The weight-average particle diameter Dw can be determined by the following formula:

$$Dw=\{1/\Sigma(nD^3)\}\times\{\Sigma(nD^4)\}$$

wherein D represents a representative diameter (μm) present in each channel and n represents a total number of particles present therein. The channel is a length equally dividing a scope of particle diameters in the particle diameter distribution, and the length is 2 μm for the carrier of the exemplary embodiment. The representative diameter present in each channel is a minimum particle diameter of the particles present in each channel.

In addition, the number-average particle diameter Dp of the carrier or the core material thereof is determined according to the particle diameter distribution measured on a number standard. The number-average particle diameter Dp can be determined by the following formula:

$$Dp=\{1/N\}\times\{\Sigma nD\}$$

wherein N represents a total number of particles measured, n represents a total number of particles present in each channel and D represents a minimum particle diameter of the particles present in each channel (2 μm).

A particle size analyzer Microtrac HRA 9320-X100 from Honeywell, Inc. of Morristown, N.J., U.S.A., is used to measure a particle diameter distribution of the carrier under the following conditions:

(1) Scope of particle diameter: 100 to 8 μm (2) Channel length (width): 2 μm (3) Number of channels: 46

(4) Refraction index: 2.42

The particle diameter distribution of the toner is measured by Coulter counter.

The carrier having an arrow particle diameter distribution of the exemplary embodiment includes a magnetic core material and a resin-coated magnetic particulate material, and therefore embodiments of the classifying method of the exemplary embodiment include the following three cases:

1. A carrier core material classified by the classifying method of the present invention is coated with a resin to prepare the carrier having a narrow particle diameter distribution.

2. After a resin-coated magnetic particulate material formed of a carrier core material coated with a resin is prepared, the resin-coated magnetic particulate material is classified by the classifying method of the exemplary embodiment to prepare the carrier having a narrow particle diameter distribution.

3. After a carrier core material classified by the classifying method of the exemplary embodiment is coated with a resin to prepare a resin-coated magnetic particulate material, the resin-coated magnetic particulate material is further classified by the classifying method of the exemplary embodiment to prepare the carrier having a narrow particle diameter distribution.

Particularly, the resin-coated magnetic particulate material as a carrier has good granularity and is difficult to adhere.

Having generally described the invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example 1

The following materials were sufficiently mixed by a blender to prepare a mixture, and the mixture was kneaded upon application of heat by a biaxial extruder to prepare a kneaded mixture.

| | |
|---|---|
| Polyester resin | 100 |
| Carnauba wax | 5 |
| Carbon black<br>#44 from Mitsubishi Chemical Corp., of Chiyoda-ku, Tokyo, Japan. | 9 |
| Compound including chrome azo<br>T-77 from HODOGAYA CHEMICAL CO., LTD., of Yokohama-shi, Kanagawa-ken, Japan. | 3 |

The kneaded mixture was cooled and crushed by a cutter mill to prepare a crushed material, the crushed material was pulverized to prepare a pulverized material and the pulverized material was classified by a wind force classifier to prepare a mother toner having an weight-average particle diameter of 5.6 μm.

Further, 1.0 parts of a particulate hydrophobic silica (R972 from Nippon Aerosil Co., Ltd., of Shinjuku-ku, Tokyo, Japan) and 100 parts of the mother toner were mixed by a HENSCHEL mixer to prepare a toner a.

Carrier Preparation Example 1

In silicone resin (SR2411 from Dow Corning Toray Silicone Co., Ltd., of Chiyoda-ku, Tokyo, Japan), carbon (KETJENBLACK EC-600JD from Lion Corp., of Sumida-ku, Tokyo, Japan) of 7% per 100% of a solid content of the silicone resin was dispersed for 60 min by a ball mill. The dispersion was diluted to prepare a dispersion having a solid content of 5%.

Further, an amino silane coupling agent (NH2(CH2)3Si(OCH3)) of 3% per 100% of the solid content of the silicone resin was mixed with the dispersion to prepare a dispersion.

The dispersion was coated on 5 kgs of a carrier core material I in Table 1 by a fluidized bed coater at 30 g/min in an atmosphere of 100° C., and was further heated at 200° C. for 2 hrs to prepare a resin-coated carrier A having a resin layer thickness of 0.31 μm. The resin layer thickness was controlled by an amount of the coating liquid, i.e., the dispersion.

The particle diameter distribution of the carrier A is shown in Tables 2-1 and 2-2.

Carrier Preparation Example 2

The carrier core material I in Table 1 was fed onto a stainless mesh at 0.5 Kgs/min to classify the carrier core material I.

A vibrating sieve used has a constitution in FIG. 1 and is a sieving apparatus 1, wherein a resonant ring 6 having a transducer 8 generating an ultrasonic wave having a frequency of 36 kHz as a resonant member is directly contacts a stainless mesh 5 (635 mesh/single) having a diameter of 70 cm, supported by a frame 9.

The stainless mesh 5 is located in a cylindrical container 2 supported by a base 4 through a spring 3. A vibration motor (not shown) is located in the base 4, which transmits a high-frequency current to the transducer 8 installed at the resonant ring 6 through a cable 7 to generate the ultrasonic wave.

The resonant ring 6 is vibrated by the ultrasonic wave, which vertically vibrates the whole mesh 5. The carrier core material fed onto the stainless mesh 5 in the cylindrical container 2 is sieved to remove undesired fine particles thereof to the bottom of the cylindrical container 2 beneath the mesh 5.

The classification was repeated to prepare a carrier core material II in Table 1.

As a result of the classification, a ratio of the carrier core material having a particle diameter less than 22 μm could largely be reduced. The particle diameter distribution of the carrier core material II is shown in Table 1.

The procedure for preparation of the resin-coated carrier A in Carrier Preparation Example 1 was repeated except for using the carrier core material II to prepare a resin-coated carrier B having a resin layer thickness of 0.3 μm.

The particle diameter distribution of the carrier B is shown in Tables 2-1 and 2-2.

In the above-mentioned classification, the mesh was scarcely clogged in a short time, but gradually clogged after classified for a long time and the mesh needed cleaning when 1,000 kgs of the core material were classified (classified for 30 hrs).

Then, the mesh was cleaned every time when 500 kgs thereof were classified, but when 2,000 kgs were classified, the mash broke and needed a replacement.

The replacement of the mesh (635 mesh) cost as much as not less than 100 yen/Kg.

Carrier Preparation Example 3

In the vibrating sieve in FIG. 1, a stainless mesh having openings of 104 μm (150 mesh) was located underneath, and a nylon mesh having openings of 20 μm was closely layered thereon. A material (nylon-66) used for the nylon mesh has a flexural modulus of 2.8 Gpa.

The stainless mesh underneath directly receives a vibration from the ultrasonic transducer, and the ultrasonic vibration is efficiently transmitted to the nylon mesh closely located thereon and the nylon mesh classifies the particles.

The carrier core material I in Table 1 was fed onto the nylon mesh at 0.5 Kgs/min to classify the carrier core material I using the vibration sieve just as classified in Carrier Preparation Example 2 to prepare a carrier core material III.

As a result of the classification, a ratio of the carrier core material having a particle diameter less than 22 μm could largely be reduced. The particle diameter distribution the carrier core material III is shown in Table 1.

The procedure for preparation of the resin-coated carrier A in Carrier Preparation Example 1 was repeated except for using the carrier core material III to prepare a resin-coated carrier C.

The particle diameter distribution of the carrier C is shown in Tables 2-1 and 2-2.

The nylon mesh was scarcely clogged in a short time, but gradually clogged after classified for a long time, and needed cleaning when 1,500 kgs of the core material were classified. The nylon mesh was cleanable by washing, but since its classifying preciseness deteriorated, the nylon mesh was replaced with a new one.

The replacement of the nylon mesh (the stainless mesh underneath does not need a replacement) cost as low as 1/10 or less than that of using only a stainless mesh.

Carrier Preparation Example 4

The procedure for preparation of the carrier core material III in Carrier preparation Example 3 was repeated except for using a polyester mesh having openings of 21 μm to prepare a carrier core material IV.

As a result of the classification, a ratio of the carrier core material having a particle diameter less than 22 μm could largely be reduced. The particle diameter distribution the carrier core material IV is shown in Table 1.

A material (polyethersulfone) used for the polyester mesh has a flexural modulus of 2.6 Gpa.

The procedure for preparation of the resin-coated carrier A in Carrier Preparation Example 1 was repeated except for using the carrier core material IV to prepare a resin-coated carrier D.

The particle diameter distribution of the carrier D is shown in Tables 2-1 and 2-2.

The polyester mesh needed cleaning when 2,000 Kgs of the core material were classified, and was replaced with a new one.

The replacement of the polyester mesh (the stainless mesh underneath does not need a replacement) cost lower than that of the nylon mesh.

Carrier Preparation Example 5

The procedure for preparation of the carrier core material III in Carrier preparation Example 3 was repeated except for using an ultra-polymer polyethylene mesh having openings of 20 μm and feeding the carrier core material I at 0.25 Kgs/min to prepare a carrier core material V.

The feeding speed of the carrier core material was reduced because of its very low passage rate, i.e., operation efficiency per classifying time.

A material (ultra-polymer polyethylene) used for the ultra-polymer polyethylene mesh has a flexural modulus of 0.9 Gpa.

As a result of the classification, a ratio of the carrier core material having a particle diameter less than 22 μm could largely be reduced. The particle diameter distribution the carrier core material V is shown in Table 1.

Further, the procedure for preparation of the resin-coated carrier A in Carrier Preparation Example 1 was repeated except for using the carrier core material V to prepare a resin-coated carrier E.

The particle diameter distribution of the carrier E is shown in Tables 2-1 and 2-2.

The polyethylene mesh needed cleaning when 2,000 Kgs of the core material were classified, and was replaced with a new one.

The replacement of the polyethylene mesh (the stainless mesh underneath does not need a replacement) cost higher than that of the nylon mesh, but lower than that of using only the stainless mesh.

Carrier Preparation Example 6

The procedure for preparation of the carrier core material III in Carrier preparation Example 3 was repeated except for using a reinforced polyester mesh including a glass fiber (hereinafter referred to as GF) of 30% and having openings of 21 μm to prepare a carrier core material VI.

A material (reinforced polyethylene terephthalate including a GF of 30%) used for the reinforced polyester mesh including a GF of 30% has a flexural modulus of 11.0 Gpa.

Further, the procedure for preparation of the resin-coated carrier A in Carrier Preparation Example 1 was repeated except for using the carrier core material VI to prepare a resin-coated carrier F.

The particle diameter distribution of the carrier F is shown in Tables 2-1 and 2-2.

The polyester mesh needed cleaning when 1,200 Kgs of the core material were classified, and was replaced with a new one.

The replacement of the reinforced polyester mesh including a GF of 30% (the stainless mesh underneath does not need a replacement) cost higher than that of the nylon mesh, but lower than that of using only the stainless mesh.

Carrier Preparation Example 7

The classification procedure for preparation of the resin-coated carrier C in Carrier Preparation Example 3 was repeated except for using the carrier A prepared in Carrier Preparation Example 1 instead of the carrier core material I to prepare a resin-coated carrier G.

The particle diameter distribution of the carrier G is shown in Tables 2-1 and 2-2.

Since the particle fluidity is better than the core material, the mesh was less clogged than the mesh which sieved the core material. However, the mesh needed cleaning when 2,000 Kgs of the core material were classified, and was replaced with a new one (the stainless mesh underneath does not need a replacement).

Carrier Preparation Example 8

In the vibrating sieve in FIG. 1, a stainless mesh having openings of 104 μm (150 mesh) was located underneath, and a nylon mesh having openings of 41 μm (NITEX41-HC from Sefar Holding Inc. in Switzerland) was closely layered thereon.

The procedure for classifying the carrier G in Carrier Preparation Example 7 was repeated except for using this mesh to prepare a resin-coated carrier H.

The particle diameter distribution of the carrier H is shown in Tables 2-1 and 2-2.

However, the carrier having a large particle diameter was removed, and the resin-coated carrier H was collected on the bottom of the cylindrical container 2 beneath the stainless mesh 5.

Carrier Preparation Example 9

The procedure for preparation of the resin-coated carrier A in Carrier Preparation Example 1 was repeated except for using a core material VII having an average particle diameter of 26.0 μm in Table 1 to prepare a resin-coated carrier I having a resin layer thickness of 0.30 μm.

The particle diameter distribution of the carrier I is shown in Tables 2-1 and 2-2.

Carrier Preparation Example 10

The procedure for preparation of the carrier core material III in Carrier preparation Example 3 was repeated except for feeding the carrier core material VII at 1 Kg/min to prepare a carrier core material VIII.

As a result of the classification, a ratio of the carrier core material having a particle diameter less than 22 μm could largely be reduced. The particle diameter distribution the carrier core material VIII is shown in Table 1.

Further, the procedure for preparation of the resin-coated carrier A in Carrier Preparation Example 1 was repeated except for using the carrier core material VIII to prepare a resin-coated carrier J having a resin layer thickness of 0.32 μm.

The particle diameter distribution of the carrier J is shown in Tables 2-1 and 2-2.

The mesh needed cleaning when 2,000 Kgs of the core material were classified, and was replaced with a new one (the stainless mesh underneath does not need a replacement).

The replacement of the mesh cost as low as 1/10 or less than that of using only a stainless mesh.

Preparation and Evaluation of Developer 7 parts of the toner a prepared in Toner Preparation Example 1 and 100 parts of each of the carriers A to J prepared in Carrier Preparation Examples 1 to 10 were mixed by a mixer for 10 min to prepare a developer.

Images were produced by a digital color copier and printer Imagio Color 4000 from Ricoh Company, Ltd., of Ohta, Tokyo, Japan, using the developer to test the granularity of the images and carrier adherence under the following conditions:

Developing gap: 0.35 mm
(between photoreceptor and developing sleeve)
Doctor gap: 0.65 mm
(between developing sleeve and doctor)
Linear speed of photoreceptor: 200 mm/sec
(Linear speed of developing sleeve/Linear speed of photoreceptor=1.80)
Writing density: 600 dpi
Charged potential (Vd): −600 V
Potential of image part after irradiated (V1): −150 V
Developing bias: DC component-500V/AC bias component: 2 KHZ, −100 V to −900V, 50% duty (1) The granularity was measured by the following formula:

$$\text{Granularity}=\exp(aL+b)f(WS(f))^{1/2}VTF(f)df$$

L: average brightness
F: space frequency (cycle/mm)
WS(f): power spectrum of brightness variation
VTF(f): visual space frequency
a, b: coefficients Rank:
◎ (very good): 0 to less than 0.1
○ (good): 0.1 to less than 0.2
Δ (usable): 0.2 to less than 0.3
X (unusable): not less than 0.3

(2) A two dot line image (100 lpi/inch) was produced in a direction of a counter-scanning direction upon application of a developing DC bias of −400V, and the carriers adhered between the two dot lines were transferred on an adhesive tape. The number of the carriers thereon (an area of 100 $cm^2$) was visually observed.
◎: Very good
○: Good
X: No good (unacceptable)

(3) Classification cost
X: as much as stainless mesh
○: lower than stainless mesh
◎: Very low cost (5) Classification efficiency
◎: Very good
○: Good
Δ: can be classified, but tend to be clogged
X: Very inefficient Evaluation results of the carriers A to J are shown in Table 3.

TABLE 1

| | Dw | Dn | Wt. % of 22 μm or less | Wt. % of 20 μm or less | Wt. % of 44 μm or less | Wt. % of 36 μm or less | Dw/Dn |
|---|---|---|---|---|---|---|---|
| Core material I | 35.8 | 26.7 | 14.2 | 8.1 | 88.3 | 59.2 | 1.34 |
| Core material II | 37.2 | 31.3 | 2.3 | 0.2 | 79.4 | 52.8 | 1.19 |

TABLE 1-continued

| | Dw | Dn | Wt. % of 22 μm or less | Wt. % of 20 μm or less | Wt. % of 44 μm or less | Wt. % of 36 μm or less | Dw/Dn |
|---|---|---|---|---|---|---|---|
| Core material III | 37.1 | 31.6 | 2.0 | 0.2 | 80.4 | 54.7 | 1.17 |
| Core material IV | 37.4 | 31.5 | 1.7 | 0.1 | 79.2 | 53.4 | 1.19 |
| Core material V | 37.7 | 31.8 | 1.5 | 0.1 | 79.7 | 53.3 | 1.19 |
| Core material VI | 37.2 | 31.4 | 2.2 | 0.2 | 80.2 | 54.3 | 1.18 |
| Core material VII | 26.0 | 19.3 | 32.1 | 17.4 | 98.7 | 95.8 | 1.35 |
| Core material VIII | 27.3 | 23.8 | 8.1 | 3.1 | 96.2 | 94.1 | 1.15 |

TABLE 2-1

| | | Uppermost mesh | |
|---|---|---|---|
| Carrier | Core material or carrier used | Material | Flexural Modulus (Gpa) |
| Carrier A | Core material I | — | — |
| Carrier B | Core material II | Stainless | 193 |
| Carrier C | Core material III | Nylon 66 | 2.8 |
| Carrier D | Core material IV | Polyether sulfone | 2.6 |
| Carrier E | Core material V | Ultra-polymer polyethylene | 0.9 |
| Carrier F | Core material VI | Reinforced polyethylenephthalate including GF of 30% | 11.0 |
| Carrier G | Carrier A | Nylon 66 | 2.8 |
| Carrier H | Carrier G | Nylon 66 | 2.8 |
| Carrier I | Core material VII | — | — |
| Carrier J | Core material VIII | Nylon 66 | 2.8 |

TABLE 3

| Carrier | Granularity | Carrier Adherence | Classification cost | Classification efficiency |
|---|---|---|---|---|
| Carrier A | X | X | — | — |
| Carrier B | ○ | ◎ | X | Δ |
| Carrier C | ○ | ◎ | ○ | ○ |
| Carrier D | ○ | ◎ | ◎ | ○ |
| Carrier E | ○ | ◎ | ○ | X |
| Carrier F | ○ | ◎ | ○ | Δ |
| Carrier G | ○ | ◎ | ◎ | ◎ |
| Carrier H | ○ | ◎ | ○ | ◎ |
| Carrier I | X | X | — | — |
| Carrier J | ◎ | ○ | ◎ | ◎ |

This application claims priority and contains subject matter related to Japanese Patent Applications Nos. 2003-388599 and 2004-206102 filed on Nov. 18, 2003 and Jul. 12, 2004 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

TABLE 2-2

| Carrier | Dw | Dn | Wt. % of 22 μm or less | Wt. % of 20 μm or less | Wt. % of 44 μm or less | Wt. % of 36 μm or less | Dw/Dn | Thickness (μm) |
|---|---|---|---|---|---|---|---|---|
| Carrier A | 36.7 | 27.3 | 14.1 | 7.8 | 88.6 | 60.4 | 1.34 | 0.31 |
| Carrier B | 37.4 | 31.8 | 1.8 | 0.1 | 80.0 | 53.6 | 1.18 | 0.30 |
| Carrier C | 37.8 | 32.4 | 1.6 | 0.1 | 80.1 | 54.5 | 1.17 | 0.30 |
| Carrier D | 37.9 | 32.1 | 1.4 | 0.1 | 79.3 | 53.2 | 1.18 | 0.30 |
| Carrier E | 38.1 | 32.7 | 1.3 | 0.0 | 80.3 | 53.4 | 1.17 | 0.31 |
| Carrier F | 37.3 | 31.6 | 1.7 | 0.1 | 80.2 | 53.7 | 1.18 | 0.29 |
| Carrier G | 37.4 | 32.5 | 1.2 | 0.0 | 80.3 | 54.6 | 1.15 | 0.30 |
| Carrier H | 34.2 | 30.3 | 1.8 | 0.0 | 95.2 | 70.2 | 1.13 | 0.30 |
| Carrier I | 26.8 | 19.6 | 31.2 | 16.3 | 97.8 | 96.5 | 1.37 | 0.30 |
| Carrier J | 27.7 | 24.2 | 6.4 | 1.7 | 95.6 | 94.2 | 1.14 | 0.32 |

What is claimed is:

1. A method of preparing a magnetic core material, comprising:

providing a high-frequency current to a converter and converting the high-frequency current to a vibration;

transmitting a vibration to a resonant member in contact with a lowermost mesh having a flexural modulus range of about 50 Gpa to 500 Gpa of at least two meshes layered together; and transmitting the vibration to an uppermost mesh of lower flexural modulus range than that of the lowermost mesh to classify the particulate material fed thereon, wherein the uppermost mesh flexural modulus range is about 1 to 10 Gpa, and the uppermost mesh having an opening range of 20 to 41 μm.

2. A method of preparing a carrier formed of a resin-coated magnetic core material, comprising:

providing a high-frequency current to a converter and converting the high-frequency current to a vibration;

transmitting a vibration to a resonant member in contact with a lowermost mesh having a flexural modulus range of about 50 Gpa to 500 Gpa of at least two meshes layered together; and transmitting the vibration to an uppermost mesh of lower flexural modulus range than that of the lowermost mesh to classify the particulate material fed thereon, wherein the uppermost mesh flexural modulus range is about 1 to 10 Gpa, and the uppermost mesh having an opening range of 20 to 41 μm.

3. A carrier formed of a resin-coated magnetic core material prepared by the method of claim 1.

4. The method of claim 1, wherein the transmitting includes transmitting the vibration having a vibration frequency range of about 20 to 50 kHz.

5. The method of claim 1, wherein the transmitting the vibration includes transmitting the vibration having a vibration frequency range of about 30 to 40 kHz.

6. The method of claim 2, wherein the transmitting includes transmitting the vibration having a vibration frequency range of about 20 to 50 kHz.

7. The method of claim 2, wherein the transmitting the vibration includes transmitting the vibration having a vibration frequency range of about 30 to 40 kHz.

* * * * *